US007055230B2

(12) United States Patent
Wu

(10) Patent No.: US 7,055,230 B2
(45) Date of Patent: Jun. 6, 2006

(54) HOLDING DEVICE FOR TIMING BELT WHEEL MODULE

(76) Inventor: Pi-Liang Wu, P.O. Box 55-124, Taichung (TW)

( * ) Notice: Subject to any disclaimer, the term of this patent is extended or adjusted under 35 U.S.C. 154(b) by 134 days.

(21) Appl. No.: 10/896,043

(22) Filed: Jul. 22, 2004

(65) Prior Publication Data

US 2006/0016058 A1 Jan. 26, 2006

(51) Int. Cl.
*B25B 27/04* (2006.01)

(52) U.S. Cl. ..... 29/281.5; 29/271

(58) Field of Classification Search ..... 29/281.5, 29/281.6, 281.1, 271, 888.011, 402.03, 402.08, 29/426.1, 464, 239; 269/253, 203, 258, 262, 269/261, 268, 278, 909, 35, 37, 82; 188/2 R, 188/4 R, 74, 36

See application file for complete search history.

(56) References Cited

U.S. PATENT DOCUMENTS 6,698,075 B1 * 3/2004 Wu ..... 29/281.5

* cited by examiner

*Primary Examiner*—Robert C. Watson

(57) ABSTRACT

A holding device for a timing belt wheel module includes a link, a first holding member secured on a distal end of the link, and a second holding member movably mounted on the link. Each of the first holding member and the second holding member includes a fixed snap plate, a movable snap plate, and a locking bolt. Thus, the holding device is used to hold timing belt wheel modules of different sizes, types and specifications without having to prepare multiple sets of holders of different sizes, types and specifications, thereby facilitating maintenance of the timing belt wheel module.

9 Claims, 7 Drawing Sheets

HOLDING DEVICE FOR TIMING BELT WHEEL MODULE

BACKGROUND OF THE INVENTION

1. Field of the Invention

The present invention relates to a holding device, and more particularly to a holding device for a timing belt wheel module.

2. Description of the Related Art

A first conventional holding device for a timing belt wheel module in accordance with the prior art shown in FIG. 4 is disclosed in the U.S. Pat. No. 6,332,256 and comprises four holding members 1, 2, 3 and 4 connected by a connecting mechanism 5. The timing belt wheel module includes two spaced timing belt wheels, and a timing belt mounted on the two spaced timing belt wheels.

In operation, the first conventional holding device is inserted between the two timing belt wheels of the timing belt wheel module, with the four holding members 1, 2, 3 and 4 being engaged with the toothed grooves of the two timing belt wheels respectively, so that the two timing belt wheels are fixed by the four holding members 1, 2, 3 and 4 of the first conventional holding device to prevent the two timing belt wheels from being rotated, thereby facilitating a user replacing the timing belt of the timing belt wheel module.

A second conventional holding device for a timing belt wheel module in accordance with the prior art shown in FIGS. 5–7 is disclosed in the applicant's U.S. Pat. No. 6,698,075 and comprises two links 6, a first holding member 7 secured on a first end of each of the two links 6, and a second holding member 8 movably mounted on each of the two links 6 so as to adjust the distance between the first holding member 7 and the second holding member 8. Each of the first holding member 7 and the second holding member 8 includes a first snap plate 702 and 802, a second snap plate 704 and 804, and a locking bolt 706 and 806. The first snap plate 702 and 802 has a first end formed with a bent snap portion 7022 and 8022 and a second end provided with a shaft tube 7024 and 8024. The second snap plate 704 and 804 has a first end formed with a bent snap portion 7042 and a second end provided with a threaded tube 7044 and 8044 juxtaposed to the shaft tube 7024 and 8024. The locking bolt 706 and 806 has a first end extended through the shaft tube 7024 and 8024 and screwed into the threaded tube 7044 and 8044, so as to combine the first snap plate 702 and 802 and the second snap plate 704 and 804, thereby forming the first holding member 7 and the second holding member 8.

In operation, the second conventional holding device is inserted between the two timing belt wheels 9 and 9' of the timing belt wheel module, with the snap portion 7022 and 8022 of the first snap plate 702 and 802 and the snap portion 7042 of the second snap plate 704 and 804 being engaged with the toothed grooves of the two timing belt wheels 9 and 9' respectively, so that the two timing belt wheels 9 and 9' are fixed by the first holding member 7 and the second holding member 8 of the second conventional holding device to prevent the two timing belt wheels 9 and 9' from being rotated, thereby facilitating a user replacing the timing belt 9" of the timing belt wheel module.

SUMMARY OF THE INVENTION

The primary objective of the present invention is to provide a holding device that is operated easily and conveniently, thereby facilitating a user replacing the timing belt of the timing belt wheel module.

Another objective of the present invention is to provide a holding device that is used to hold timing belt wheel modules of different sizes, types and specifications without having to prepare multiple sets of holders of different sizes, types and specifications, thereby facilitating maintenance of the timing belt wheel module.

A further objective of the present invention is to provide a holding device having a simplified construction, thereby decreasing costs of fabrication.

In accordance with the present invention, there is provided a holding device, comprising a link, a first holding member secured on a distal end of the link, and a second holding member movably mounted on the link, wherein:

each of the first holding member and the second holding member includes a fixed snap plate, a movable snap plate, and a locking bolt;

the fixed snap plate of each of the first holding member and the second holding member has a first end formed with a bent first snap portion and a second end provided with a threaded tube;

the movable snap plate of each of the first holding member and the second holding member has a first end formed with a bent second snap portion and a second end provided with a pivot tube juxtaposed to and pivotally mounted on the threaded tube of the fixed snap plate; and the locking bolt of each of the first holding member and the second holding member has a first end extended through the pivot tube of the movable snap plate and screwed into the threaded tube of the fixed snap plate, so as to combine the fixed snap plate and the movable snap plate.

Further benefits and advantages of the present invention will become apparent after a careful reading of the detailed description with appropriate reference to the accompanying drawings.

DETAILED DESCRIPTION OF THE INVENTION

Figure 1:
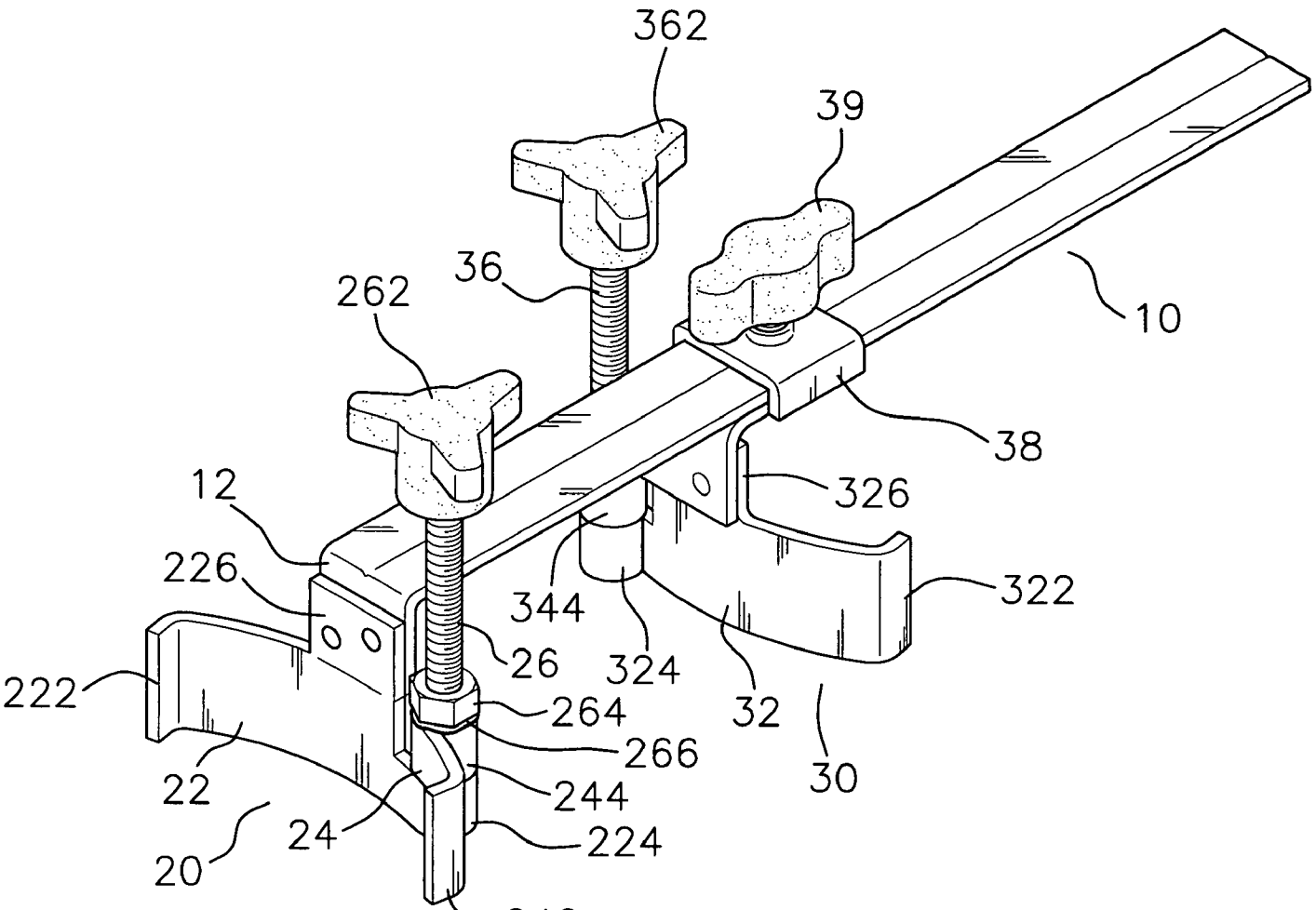
FIG. 1 is a perspective view of a holding device in accordance with the preferred embodiment of the present invention.
Figure 2:
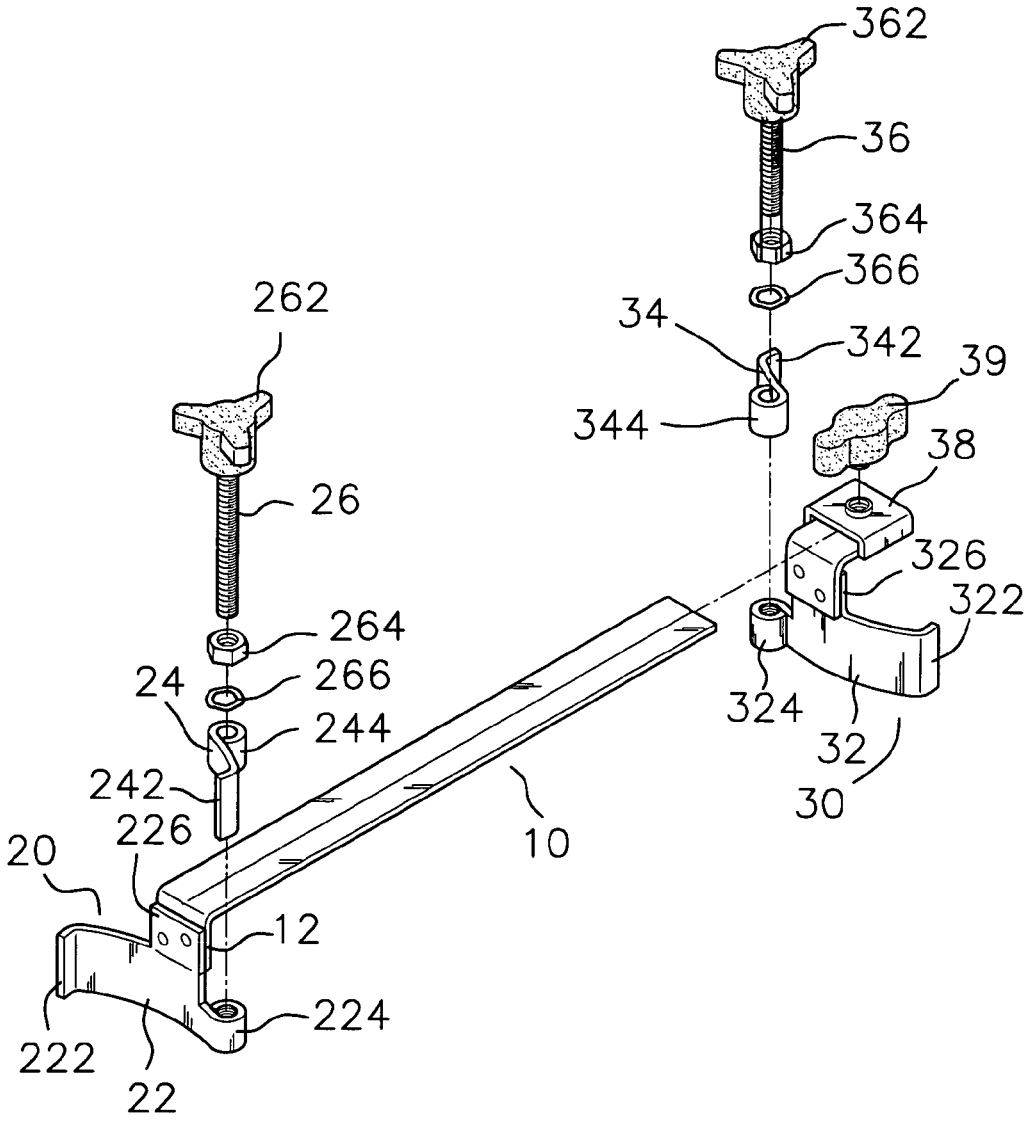
FIG. 2 is an exploded perspective view of the holding device as shown in FIG. 1.

Referring to the drawings and initially to FIGS. 1 and 2, a holding device for a timing belt wheel module in accordance with the preferred embodiment of the present invention comprises a link 10, a first holding member 20 secured on a distal end of the link 10, and a second holding member 30 movably mounted on the link 10 so as to adjust the distance between the first holding member 20 and the second holding member 30.

The link 10 is an elongated plate having a rectangular cross-section along a transverse direction thereof. The distal end of the link 10 is formed with a bent connecting portion 12.

Each of the first holding member 20 and the second holding member 30 includes a fixed snap plate 22 and 32, a movable snap plate 24 and 34, and a locking bolt 26 and 36.

The fixed snap plate 22 and 32 of each of the first holding member 20 and the second holding member 30 has a first end formed with a bent first snap portion 222 and 322 and a second end provided with a threaded tube 224 and 324. The fixed snap plate 22 and 32 of each of the first holding member 20 and the second holding member 30 has a mediate portion formed with a protruding connecting tongue 226 and 326. The connecting tongue 226 of the fixed snap plate 22 of the first holding member 20 is secured on the connecting portion 12 of the link 10.

The movable snap plate 24 and 34 of each of the first holding member 20 and the second holding member 30 has a first end formed with a bent second snap portion 242 and 342 and a second end provided with a pivot tube 244 and 344 juxtaposed to and pivotally mounted on the threaded tube 224 and 324 of the fixed snap plate 22 and 32.

The locking bolt 26 and 36 of each of the first holding member 20 and the second holding member 30 has a first end extended through the pivot tube 244 and 344 of the movable snap plate 24 and 34 and screwed into the threaded tube 224 and 324 of the fixed snap plate 22 and 32, so as to combine the fixed snap plate 22 and 32 and the movable snap plate 24 and 34, thereby forming the first holding member 20 and the second holding member 30. The locking bolt 26 and 36 of each of the first holding member 20 and the second holding member 30 has a second end provided with a butterfly head 262 and 362.

Each of the first holding member 20 and the second holding member 30 further includes a nut 264 and 364 screwed onto the locking bolt 26 and 36 and rested on the pivot tube 244 and 344 of the movable snap plate 24 and 34, and an elastic washer 266 mounted on the locking bolt 26 and 36 and located between the nut 264 and 364 and the pivot tube 244 and 344 of the movable snap plate 24 and 34.

The second holding member 30 further includes a slide sleeve 38 secured on the connecting tongue 326 of the fixed snap plate 32 of the second holding member 30 and movably mounted on the link 10, and a positioning bolt 39 screwed onto the slide sleeve 38 and having a distal end extended through the slide sleeve 38 and urged on the link 10 to position the second holding member 30 on the link 10.

Figure 3:
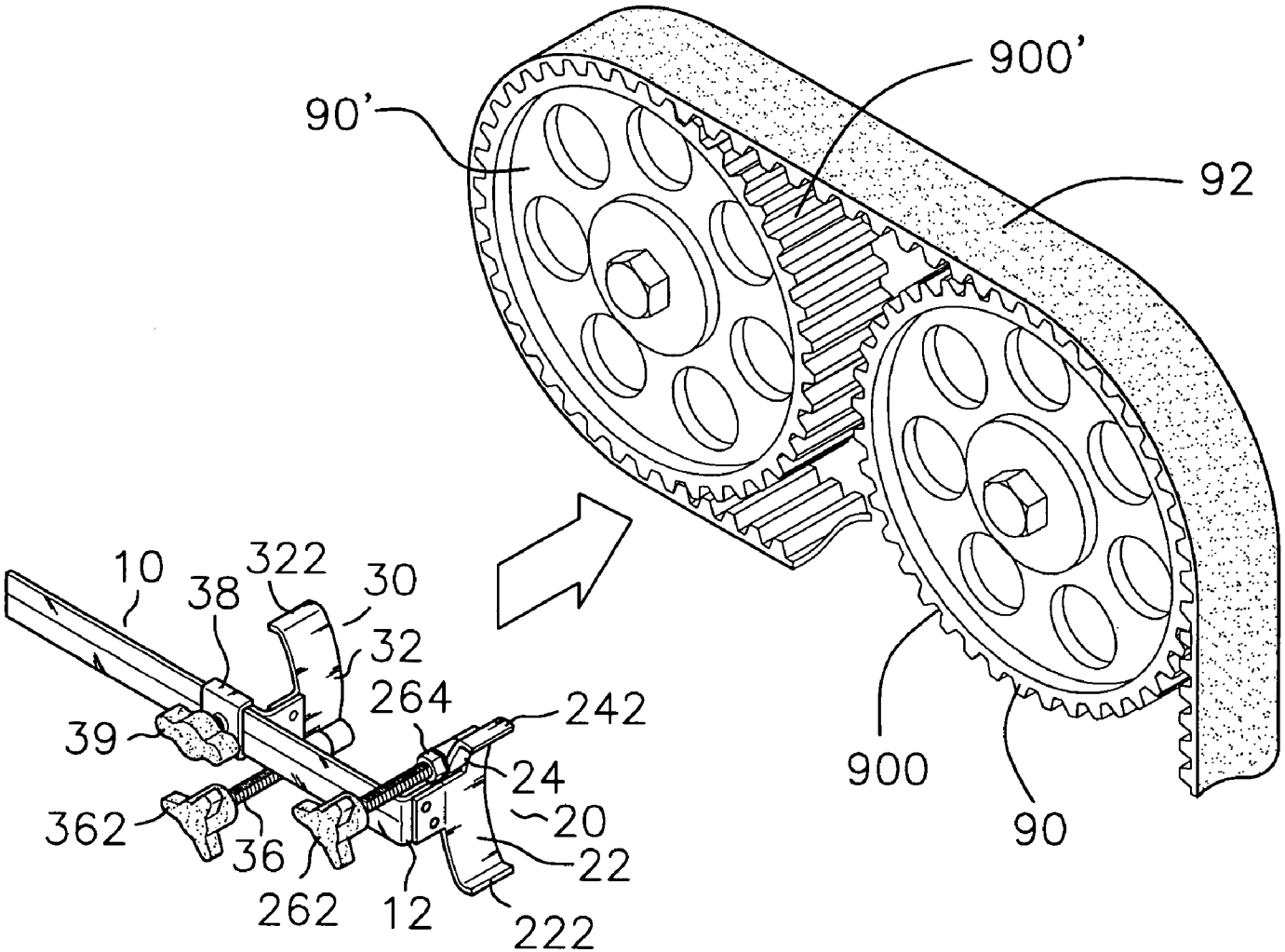
FIG. 3 is a perspective view of the holding device for a timing belt wheel module in accordance with the preferred embodiment of the present invention.
Figure 4:
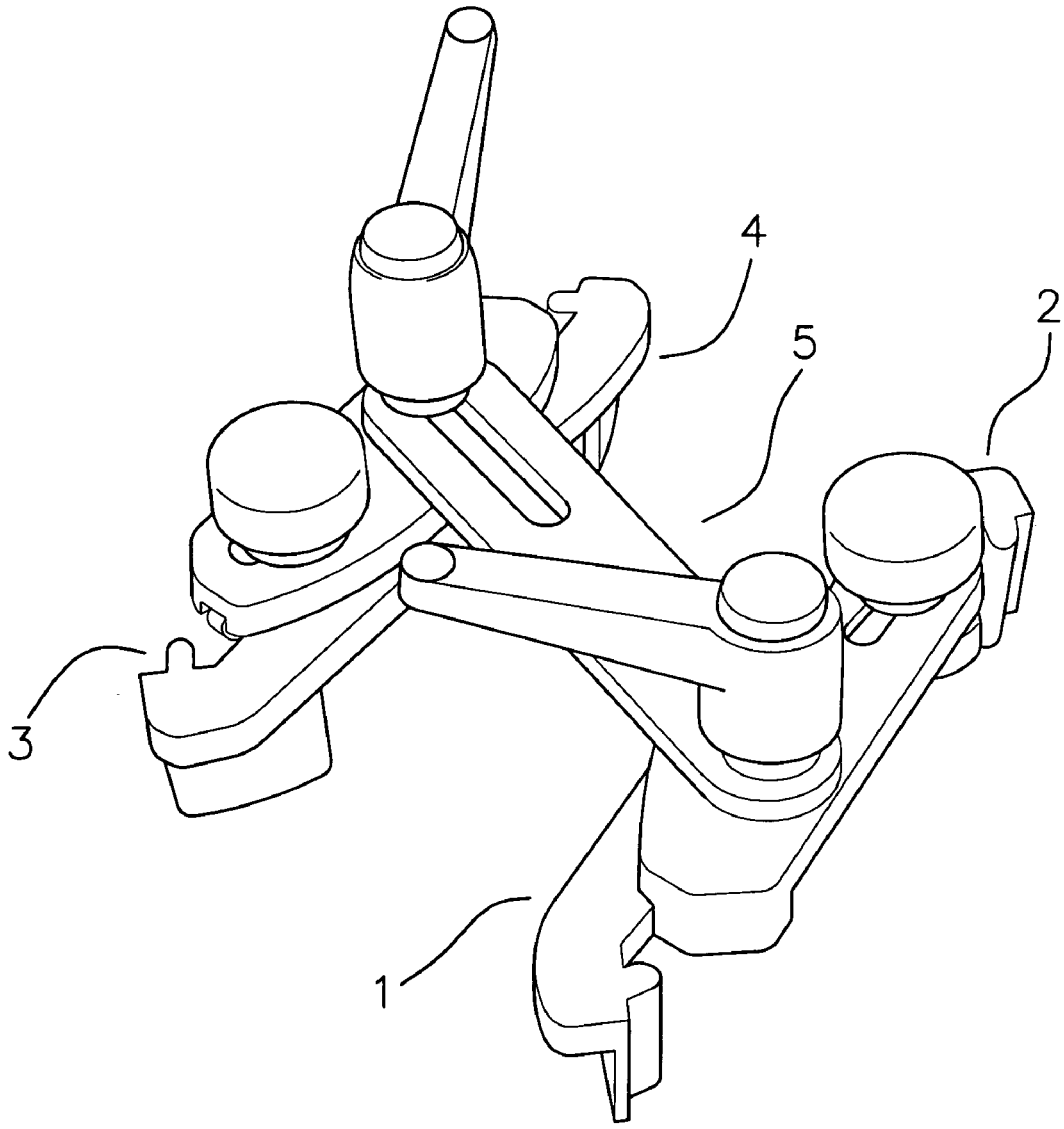
FIG. 4 PRIOR ART
FIG. 4 is a perspective view of a first conventional holding device for a timing belt wheel module in accordance with the prior art.
Figure 5:
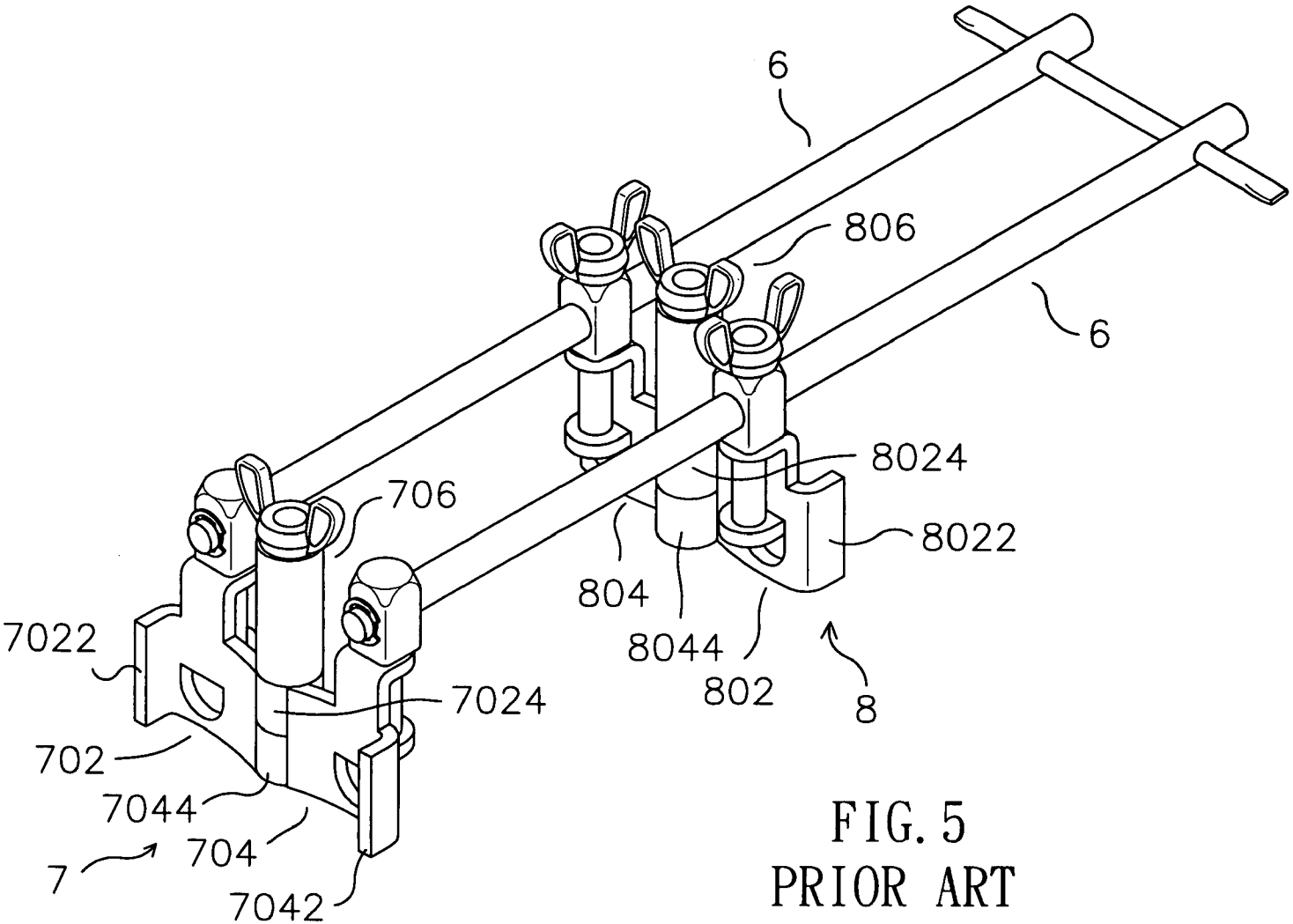
FIG. 5 PRIOR ART
FIG. 5 is a perspective view of a second conventional holding device for a timing belt wheel module in accordance with the prior art.
Figure 6:
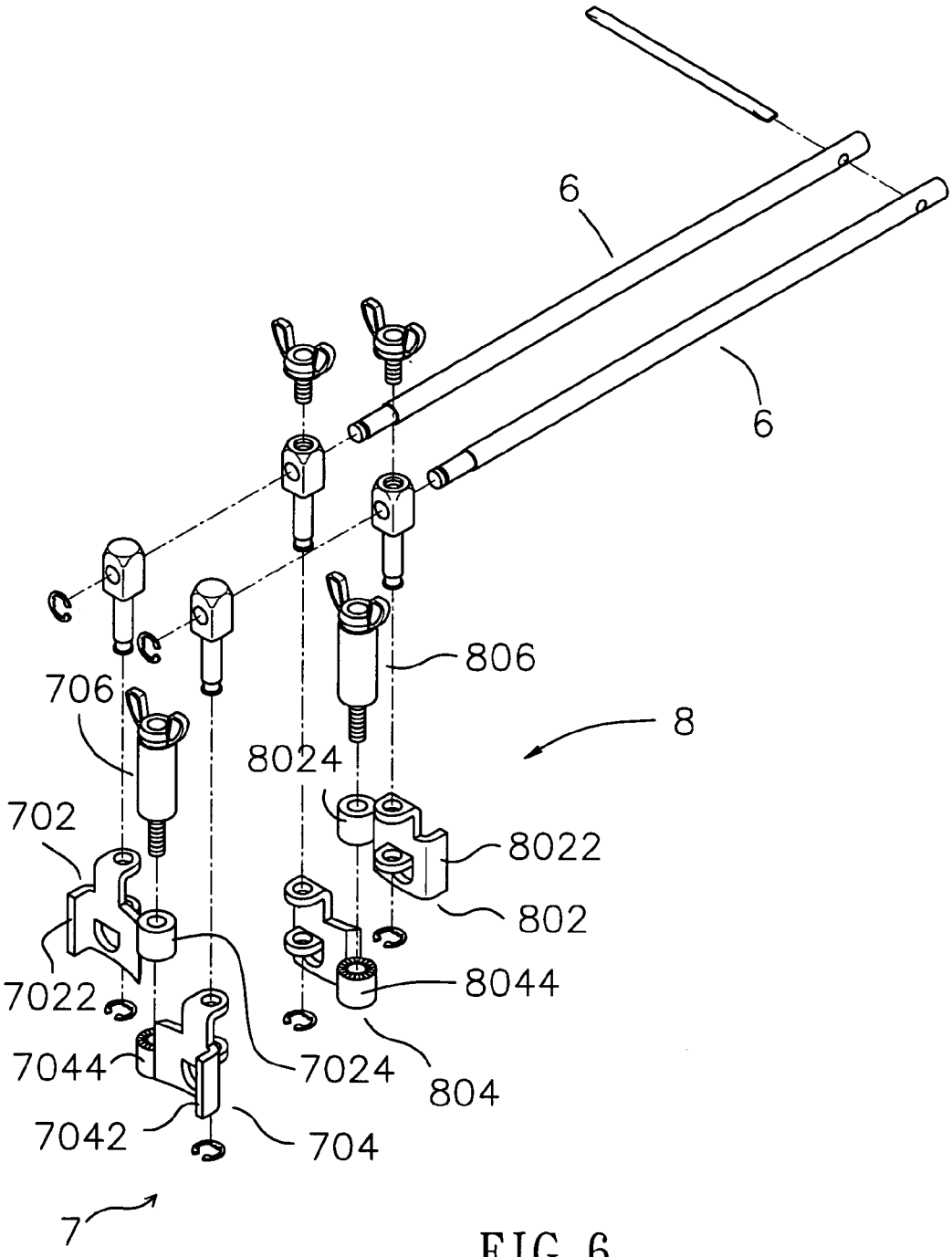
FIG. 6 PRIOR ART
FIG. 6 is an exploded perspective view of the second conventional holding device as shown in FIG. 5.
Figure 7:
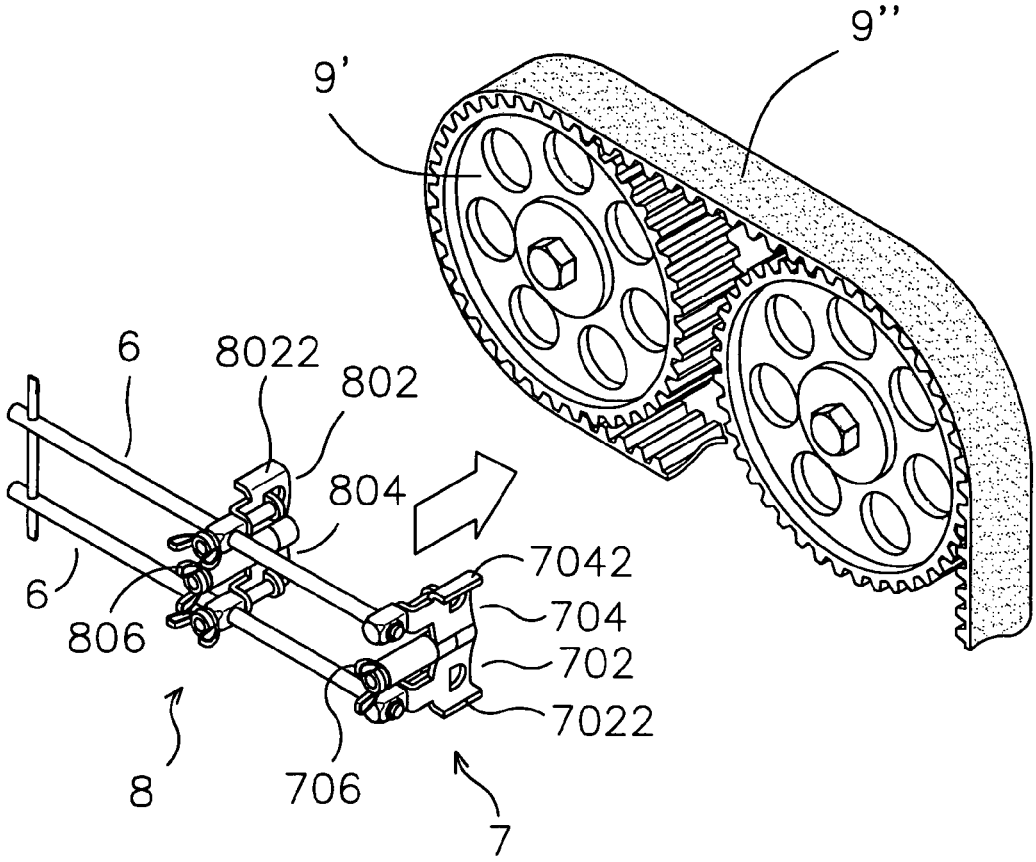
FIG. 7 PRIOR ART
FIG. 7 is a perspective view of the second conventional holding device for a timing belt wheel module in accordance with the prior art.

In operation, referring to FIGS. 1–3, the holding device is used to hold two timing belt wheels 90 and 90' of the timing belt wheel module having a timing belt 92 mounted on the two timing belt wheels 90 and 90'.

First of all, the positioning bolt 39 is unscrewed, so that the slide sleeve 38 of the second holding member 30 is axially movable on the link 10 so as to adjust the distance between the first holding member 20 and the second holding member 30. Then, the locking bolt 26 and 36 of each of the first holding member 20 and the second holding member 30 is unscrewed, so that the movable snap plate 24 and 34 of each of the first holding member 20 and the second holding member 30 can be pivoted freely relative to the fixed snap plate 22 and 32. Then, the first holding member 20 and the second holding member 30 are inserted between the two timing belt wheels 90 and 90' and are adjusted to fit the two timing belt wheels 90 and 90' until the first snap portion 222 and 322 of the fixed snap plate 22 and 32 of each of the first holding member 20 and the second holding member 30 is inserted into and locked in the toothed groove 900 and 900' formed in the periphery of each of the timing belt wheels 90 and 90' respectively. Then, the positioning bolt 39 is screwed closely to position the slide sleeve 38 so that the second holding member 30 is fixed on the link 10. Then, the movable snap plate 24 and 34 of each of the first holding member 20 and the second holding member 30 is pivoted relative to the fixed snap plate 22 and 32 to fit the two timing belt wheels 90 and 90' until the second snap portion 242 and 342 of the movable snap plate 24 and 34 of each of the first holding member 20 and the second holding member 30 is inserted into and locked in the toothed groove 900 and 900' of each of the timing belt wheels 90 and 90' respectively. Finally, the locking bolt 26 and 36 of each of the first holding member 20 and the second holding member 30 is screwed closely, so that the movable snap plate 24 and 34 of each of the first holding member 20 and the second holding member 30 is fixed on the fixed snap plate 22 and 32.

In such a manner, the two timing belt wheels 90 and 90' of the timing belt wheel module are respectively fixed by the first holding member 20 and the second holding member 30 of the holding device rigidly and stably, thereby facilitating the user replacing the timing belt 92 of the timing belt wheel module.

Accordingly, the holding device is operated easily and conveniently, thereby facilitating a user replacing the timing belt of the timing belt wheel module. In addition, the holding device is used to hold timing belt wheel modules of different sizes, types and specifications without having to prepare multiple sets of holders of different sizes, types and specifications, thereby facilitating maintenance of the timing belt wheel module. Further, the holding device has a simplified construction, thereby decreasing costs of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A holding device, comprising a link, a first holding member secured on a distal end of the link, and a second holding member movably mounted on the link, wherein:

each of the first holding member and the second holding member includes a fixed snap plate, a movable snap plate, and a locking bolt;

the fixed snap plate of each of the first holding member and the second holding member has a first end formed with a bent first snap portion and a second end provided with a threaded tube;

the movable snap plate of each of the first holding member and the second holding member has a first end formed with a bent second snap portion and a second end provided with a pivot tube juxtaposed to and pivotally mounted on the threaded tube of the fixed snap plate; and the locking bolt of each of the first holding member and the second holding member has a first end extended through the pivot tube of the movable snap plate and screwed into the threaded tube of the fixed snap plate, so as to combine the fixed snap plate and the movable snap plate.

2. The holding device in accordance with claim 1, wherein the second holding member further includes a slide sleeve secured on the fixed snap plate of the second holding member and movably mounted on the link.

3. The holding device in accordance with claim 2, wherein the fixed snap plate of the second holding member has a mediate portion formed with a protruding connecting tongue, and the slide sleeve is secured on the connecting tongue of the fixed snap plate of the second holding member.

4. The holding device in accordance with claim 2, wherein the second holding member further includes a positioning bolt screwed onto the slide sleeve and having a distal end extended through the slide sleeve and urged on the link to position the second holding member on the link.

5. The holding device in accordance with claim 1, wherein the distal end of the link is formed with a bent connecting portion, and the fixed snap plate of the first holding member has a mediate portion formed with a protruding connecting tongue secured on the connecting portion of the link.

6. The holding device in accordance with claim 1, wherein the link is an elongated plate having a rectangular cross-section along a transverse direction thereof.

7. The holding device in accordance with claim 1, wherein the locking bolt of each of the first holding member and the second holding member has a second end provided with a butterfly head.

8. The holding device in accordance with claim 1, wherein each of the first holding member and the second holding member further includes a nut screwed onto the locking bolt and rested on the pivot tube of the movable snap plate.

9. The holding device in accordance with claim 8, wherein each of the first holding member and the second holding member further includes an elastic washer mounted on the locking bolt and located between the nut and the pivot tube of the movable snap plate.

* * * * *